US007247005B2

(12) United States Patent
Fuchida et al.

(10) Patent No.: US 7,247,005 B2
(45) Date of Patent: Jul. 24, 2007

(54) OIL SEAL ARRANGEMENT

(75) Inventors: Takeshi Fuchida, Asahi-machi (JP); Yoshitake Hisada, Asahi-machi (JP)

(73) Assignee: Advics Co., Ltd., Kariya, Aichi (JP)

( * ) Notice: Subject to any disclaimer, the term of this patent is extended or adjusted under 35 U.S.C. 154(b) by 459 days.

(21) Appl. No.: 10/624,673

(22) Filed: Jul. 23, 2003

(65) Prior Publication Data

US 2005/0191189 A1 Sep. 1, 2005

(30) Foreign Application Priority Data

Jul. 24, 2002 (JP) ..... 2002-215118

(51) Int. Cl.
*F01C 19/00* (2006.01)

(52) U.S. Cl. ..... 417/410.3; 92/168

(58) Field of Classification Search ..... 417/410.4; 418/104; 92/86, 168
See application file for complete search history.

(56) References Cited

U.S. PATENT DOCUMENTS

| | | | | |
|---|---|---|---|---|
| 3,943,717 | A * | 3/1976 | Schexnayder | 92/86 |
| 4,382,756 | A * | 5/1983 | Chronowski et al. | 418/104 |
| 5,201,647 | A * | 4/1993 | Niemiec et al. | 418/104 |
| 5,662,462 | A * | 9/1997 | Paley et al. | 418/102 |
| 6,389,955 | B1 * | 5/2002 | Schaefer | 92/86 |

FOREIGN PATENT DOCUMENTS

| | | | |
|---|---|---|---|
| JP | 61-178587 | * | 8/1986 |
| JP | 62-013872 | A | 1/1987 |
| JP | 2-11274 | U | 1/1990 |
| JP | 2-87975 | U | 7/1990 |
| JP | 02-271167 | A | 11/1990 |
| JP | 4-58073 | A | 2/1992 |
| JP | 4-58074 | A | 2/1992 |
| JP | 2000-009058 | A | 1/2000 |
| JP | 2001-080498 | A | 3/2001 |

OTHER PUBLICATIONS

Notice of Grounds of Rejection issued by Japanese Patent Office on May 30, 2006 and partial English language translation thereof.

* cited by examiner

*Primary Examiner*—Michael Koczo, Jr.
(74) *Attorney, Agent, or Firm*—Buchanan Ingersoll & Rooney PC

(57) ABSTRACT

A motor-driven gear pump assembly includes a rotary shaft rotatably mounted in a housing, and a pump mounted on the rotary shaft. The pump has a pressure chamber. A high-pressure seal is disposed around the shaft between the pump and the motor. A low-pressure seal is provided around the shaft between the high-pressure seal and the motor. An annular oil seal chamber is formed between the high-pressure seal and the low-pressure seal to surround the shaft. A recess chamber is formed around the oil seal chamber. Oil is introduced into the oil seal chamber until the portion of the rotary shaft in the oil seal chamber is completely submerged in the oil introduced while leaving air in the oil seal chamber. The oil in the oil seal chamber thus serves as a seal which positively prevents infiltration of air into the pump. If oil in the pump leaks through the high-pressure seal into the oil seal chamber, the air is compressed, thus absorbing any increase in the volume of oil.

17 Claims, 6 Drawing Sheets

OIL SEAL ARRANGEMENT

BACKGROUND OF THE INVENTION

This invention relates to an oil seal arrangement for use with an oil pump used in a vehicle brake actuator or a shock absorber.

As oil pump assemblies used in vehicle brake actuators, a gear pump is disclosed in JP patent publication 2000-9058 or 2001-80498. The gear pump will be described with reference to FIGS. 1 and 2. (Note that FIGS. 1 and 2 show an oil seal arrangement embodying the invention.)

This gear pump assembly includes a housing H formed with suction ports 1 through which oil a is drawn into the housing H and discharge ports 2 through which pressurized oil a is discharged. In the housing H, a rotary shaft 3 driven by a motor M extends in the axial direction of the housing H. The rotary shaft 3 carries a plurality of pump units 10 arranged in the axial direction of the shaft 3. Each pump unit 10 comprises an inner rotor 4 fixed to the rotary shaft 3, and an outer rotor 5 disposed in a casing 7*d* or 7*e* so as to be rotatable and eccentric to and in mesh with the inner rotor 4.

In order to prevent brake oil a pressurized in the pump units 10 from leaking to outside through gaps between the rotary shaft 3 and cylinders 7*a* and 7*c*, high-pressure oil seals 8 are disposed therebetween. Further, in order to prevent leak of such pressurized brake fluid even if the high-pressure seals 8 fail, a low-pressure seal 9 is provided between an axially outer portion of the cylinder 7*c* and the rotary shaft 3.

As the inner and outer rotors of each pump unit 10 rotate, positive pressure and negative pressure are alternately produced in each chamber defined in the pump units. Negative pressure tends to draw outer air into the pump units 10 through the high-pressure seals 8. Air drawn into the pump units will have undue influence on the function of the brake actuator.

An object of this invention is to provide an oil seal arrangement for such a gear pump which includes, besides the high-pressure seals and low-pressure seal, additional sealing means that can positively prevent infiltration of air into the pumps under negative pressure produced in the pumps.

SUMMARY OF THE INVENTION

According to the invention, there is provided an oil seal arrangement for a casing in which oil is filled and positive and negative oil pressures are alternately produced, the oil seal arrangement comprising a high-pressure seal and a low-pressure seal provided in this turn for preventing oil in the casing from leaking to outside, characterized in that an oil seal chamber is provided between the high-pressure seal and the low-pressure seal, the oil seal chamber containing oil of the same quality as the oil in the casing.

The oil in the oil seal chamber, which is a liquid, has a high sealability. Since the oil in the oil seal chamber is of the same quality as the oil in the casing, even if the former mixes into the latter, this will pose no problems whatsoever. As used herein, "oil of the same quality" encompasses any oil that will have no significant undue influence on the oil in the casing even if they are mixed together.

The oil seal chamber is not filled with oil but preferably has an air layer. If oil in the casing should leak through the high-pressure seal into the oil seal chamber, the air in the oil seal chamber will be compressed, thereby absorbing any increase in the volume of the oil seal chamber. This prevents excessive and sharp pressure increase in the oil seal chamber, thus preventing failure of the low-pressure seal.

According to the present invention, there is also provided an oil seal arrangement wherein the casing is a cylinder, a motor mounted in the pump cylinder, the rotary shaft extending from the motor into the cylinder, a pump unit driven by the motor to suck and discharge oil from and into the cylinder, the oil seal chamber being provided between the pump and the motor around the rotary shaft, the high-pressure seal being disposed between the pump and the oil seal chamber, the oil seal chamber disposed between the high-pressure seal and the low-pressure seal around the rotary shaft, and the low-pressure seal being disposed between the oil seal chamber and the motor around the rotary shaft, the oil seal chamber being filled with such an amount of oil that the rotary shaft will be completely submerged in the oil in the oil seal chamber, the oil being of the same quality as the oil in the cylinder.

Oil may be injected into the oil seal chamber through a hole formed in the casing such as a cylinder. But the oil seal arrangement may further comprises a recess chamber formed in the outer periphery of the casing, a first passage through which the recess chamber communicates with the oil seal chamber, and an oil injection port communicating with the recess chamber. Since oil flows into the recess chamber, too, the entire amount of oil increases. Also, control of the amount becomes easier. The provision of a recess chamber makes easier the injection of oil.

The first passage is always submerged in the oil layer in the oil seal chamber. The oil seal arrangement preferably further comprises a second passage through which the recess chamber communicates with the oil seal chamber.

With this arrangement, oil flows into the oil seal through the second passage and through the recess chamber and the first passage. Thus, oil can smoothly flow into the oil seal chamber, while replacing air. The recess chamber communicates with the oil seal chamber through the first passage. Thus, the oil in the oil chamber is kept at the same level as the oil in the recess, so that one can check the oil level in the oil seal chamber by checking the oil level in the recess chamber. But ordinarily, the oil level in the oil seal chamber is determined based on the amount of oil injected.

Preferably, the oil seal chamber and the recess chamber have both an oil layer and an air layer, the first passage is formed at a portion submerged in the oil layers of the oil seal chamber and the recess chamber, and the second passage is formed at a portion communicating with the air layers of the oil seal chamber and the recess chamber. With this arrangement, the first passage serves as an air vent when oil is injected into the oil seal chamber.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

Figure 1:
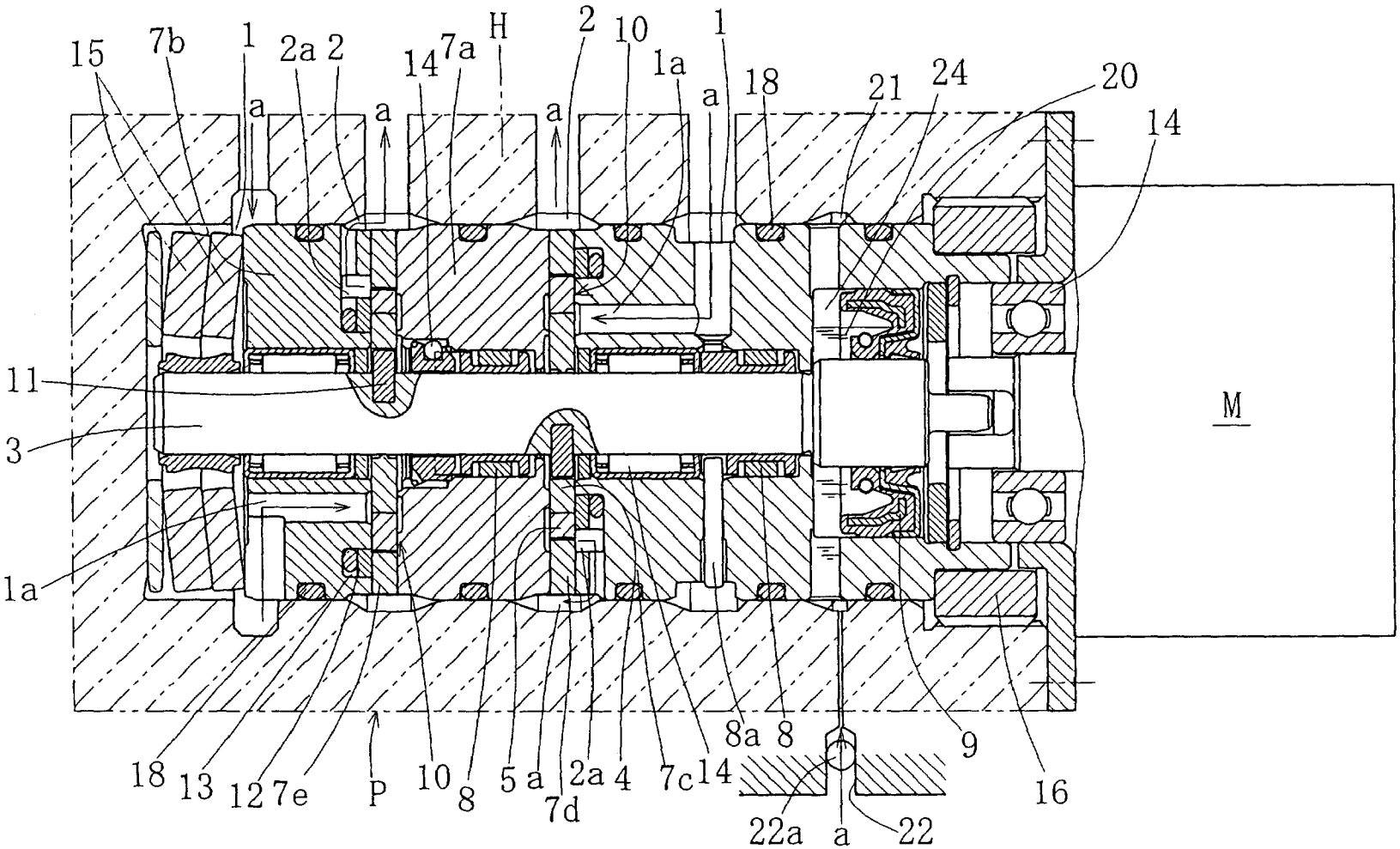
FIG. 1 is a partially cutaway front view of a first embodiment.
Figure 2:
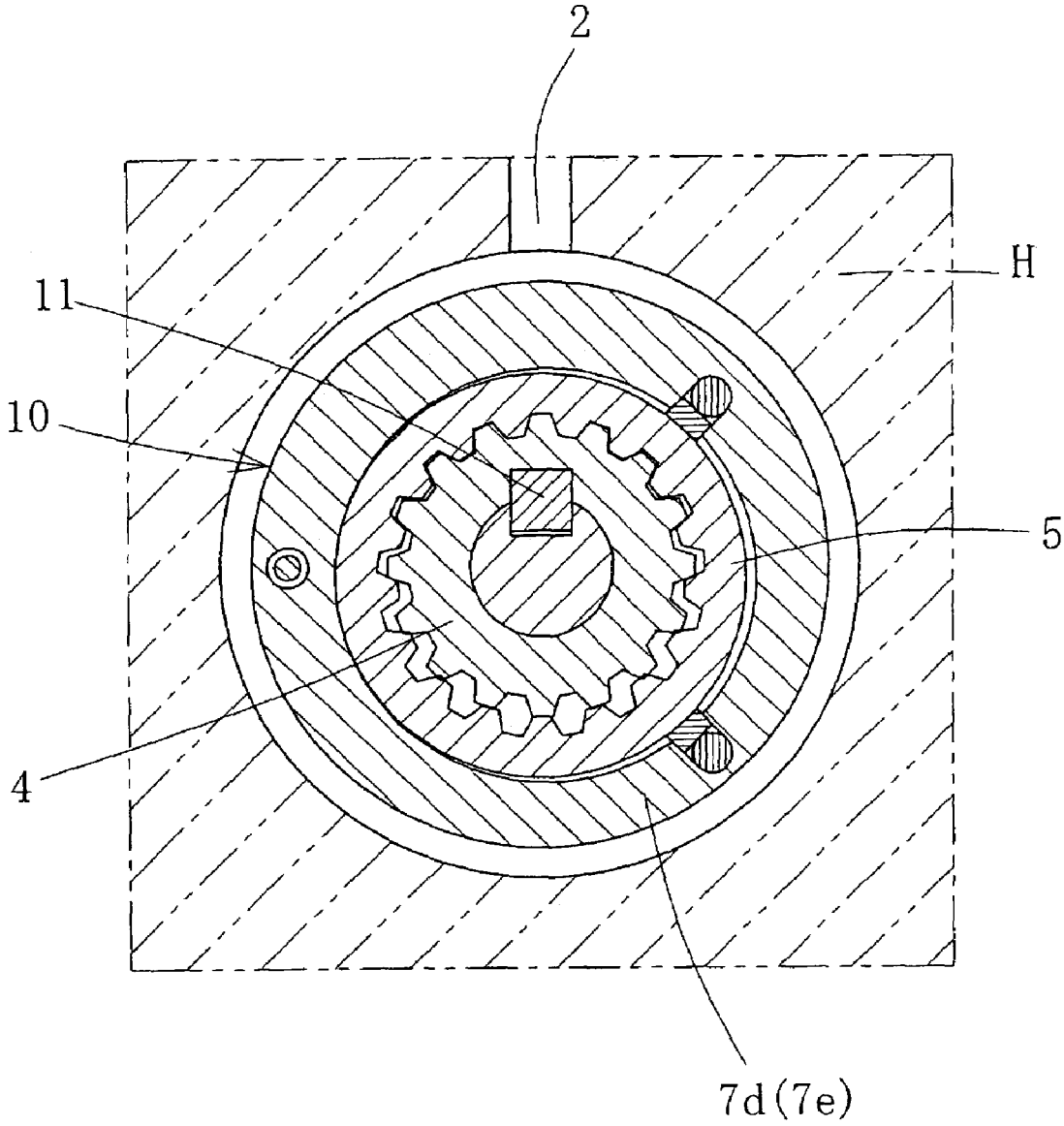
FIGS. 2 and 3 are sectional views of the embodiment of FIG. 1.
Figure 3:
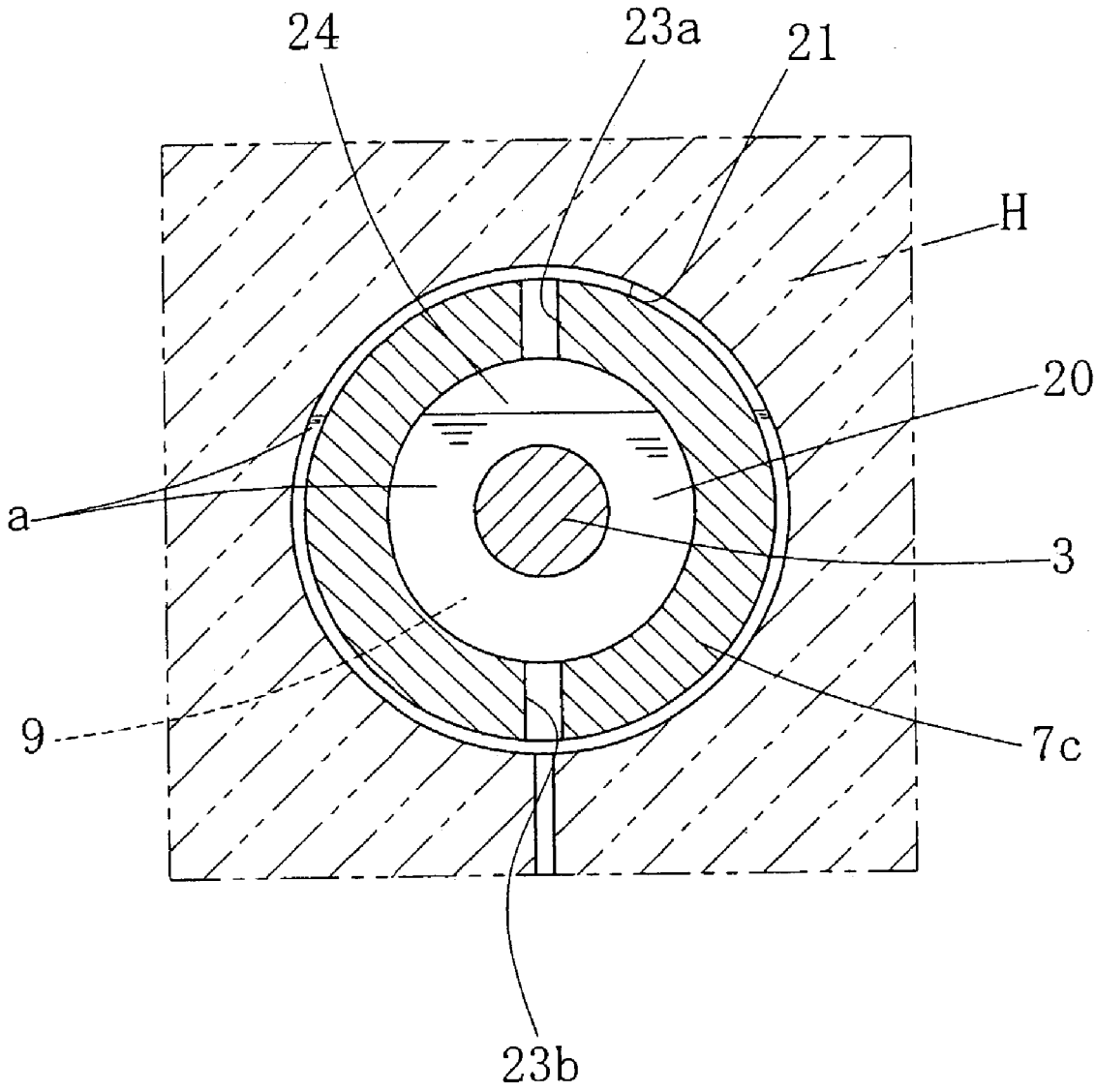

FIGS. 1 to 3 show one embodiment of the present invention applied to an oil gear pump P which has two pump units 10 mounted in the housing H of a vehicle brake actuator. The pump driving motor M is bolted to a flange of the cylinder 7*c*.

Each pump unit 10 has an inner rotor 4 fixed to the rotary shaft 3 by keys 11 and an outer rotor 5 mounted in the casing 7*d* or 7*e* so as to be rotatable and eccentric to and in mesh with the inner rotor 4. Gaps are defined between the inner and outer rotors 4, 5 as shown in FIG. 2. When the rotary shaft 3 is rotated by the motor M, the inner and outer rotors 4, 5 of each pump unit rotate together. As the rotors rotate, the volume of each of such gaps alternately increases and decreases. Each inlet port 1 communicates with one side of such gaps through a fluid line 1*a*, while each outlet port 2 communicates with the other side of the gaps through a fluid line 2*a*. Thus, oil a is sucked into the gaps from the suction port 1 under negative pressure in the gaps and discharged from the gaps into the discharge port 2 under positive pressure in the gaps.

Each pump unit 10 is disposed between the cylinder 7*a* and one of the cylinders 7*b* and 7*c*. The casing 7*d* is welded to the cylinder 7*a* and the cylinder 7*c* along its entire outer edge. The casing 7*e* is welded to the cylinder 7*a* and the cylinder 7*b* along its entire outer edge. Each fluid line 1*a* and 2*a*, the suction port 1 and the discharge port 2 are formed in one of the cylinders 7*b* and 7*c*. Each of the cylinders 7*b* and 7*c* is further formed with an annular groove 13 in its surface opposing the pump unit 10. A seal member 12 fills the groove 13 to separate the fluid lines 1*a* and 2*a* from each other.

The rotary shaft 3 is rotatably supported by the cylinders 7*a*, 7*b* and 7*c* (the entire cylinders are denoted by numeral 7) through bearings. The pump assembly P is fastened in position in the housing H by leaf springs 15 disposed between the end wall of the housing H and one end of the cylinder 7*b*, and a nut 16 threaded into the housing H while abutting the cylinder 7*c*.

One of the high-pressure seals 8 is provided between the cylinder 7*a* and the rotary shaft 3 to separate the gear pump units 10 from each other. The other high-pressure seal 8, which is disposed between the cylinder 7*c* and the rotary shaft 3, separates one of the pump units 10 from the motor M. Axially outside of the other high-pressure seal 8, in the cylinder 7*c* around the rotary shaft 3, an oil seal chamber 20 is defined. The low-pressure seal 9 forms the axially outer wall of the oil seal chamber 20. A member 8*a* prevents slipping of the high-pressure seal 8.

An annular recess chamber 21 is formed on the inner surface of housing H and on the outer surface of the cylinder 7*c*. At its lowest portion (in FIG. 1), the recess chamber 21 communicates with an oil injection port 22 formed in the housing H. At its highest and lowest points, the recess chamber 21 also communicates with the oil seal chamber 20 through passages 23*a* and 23*b*, respectively (FIG. 3). When oil a of the same type as brake oil that is sucked into and discharged from the pump unit 10 is injected through the oil injection port 22, the oil will flow into the oil seal chamber 20 through passages 23*a* and 23*b* until the rotary shaft 3 in the chamber 20 is completely submerged in the oil as shown in FIG. 3. In this state, the oil in the oil seal chamber 20 serves as an additional seal between the rotary shaft 3 and the cylinder 7*c*. That is, it completely prevents leak of air into the pump units 10.

An air layer 24 is present in the chamber 20 over the oil layer. If oil should leak from the pump units 10 into the oil seal chamber 20, the air layer 24 will be compressed, thus preventing any excessive and sharp pressure rise in the chamber 20.

The oil injection port 22 is closed by e.g. pressing a steel ball 22*a* into the port 22. O-rings 18 are provided between the housing and the cylinders 7.

Figure 4A:
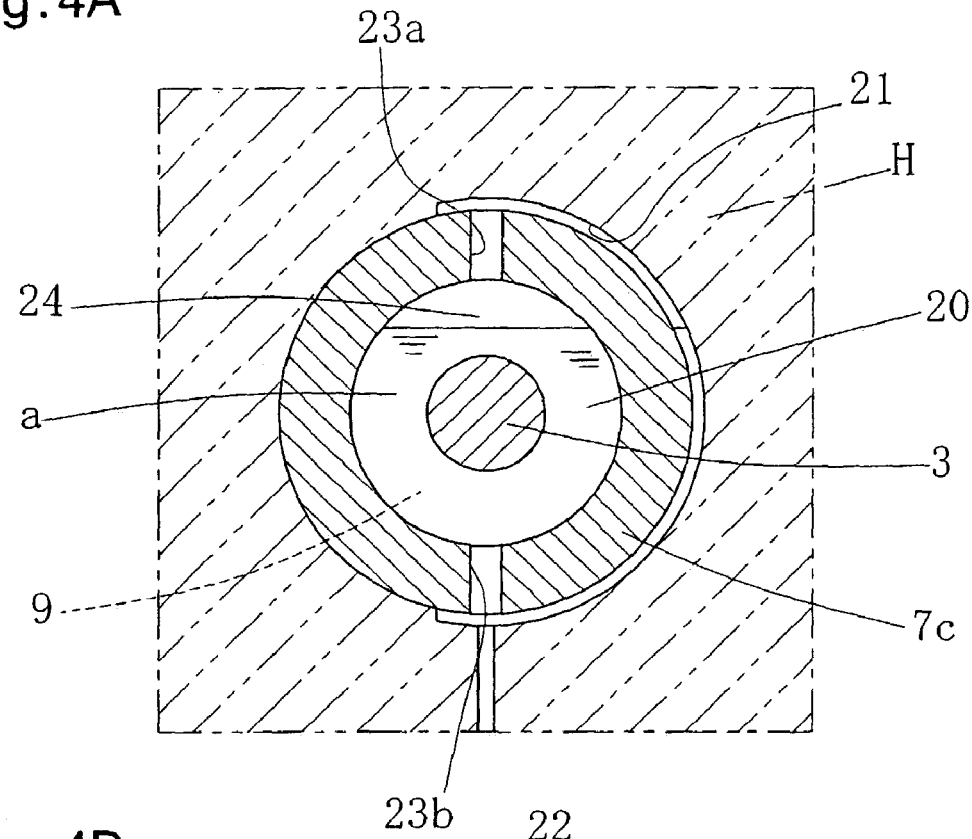
FIGS. 4A and 4B are sectional views of other embodiments.
Figure 4B:
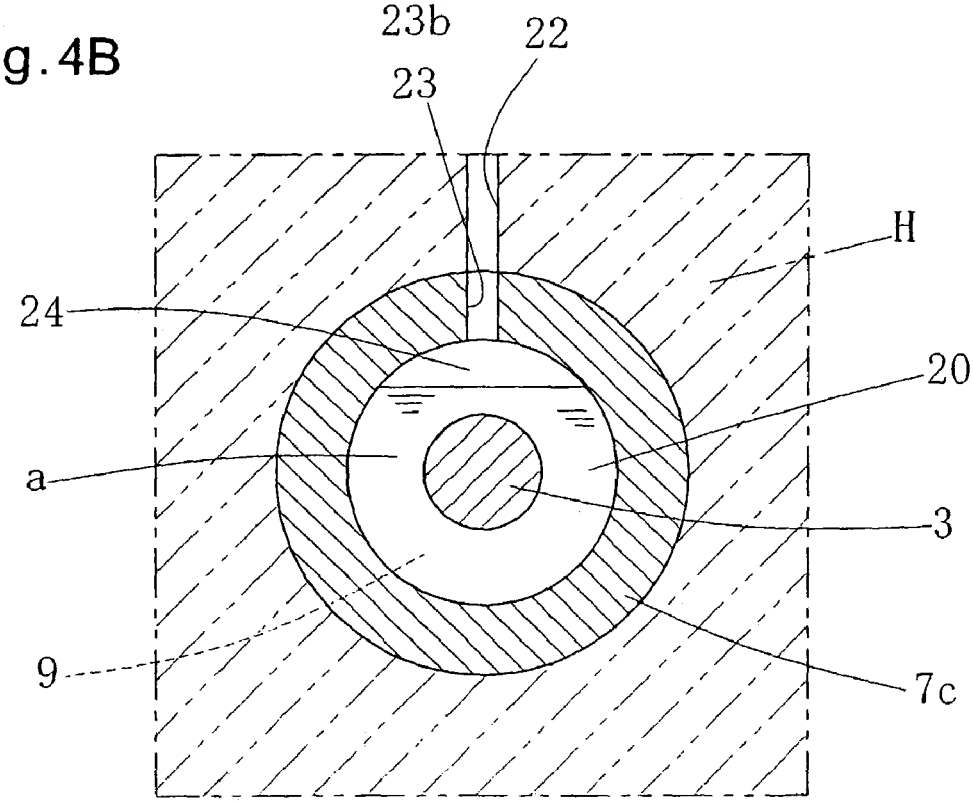

As shown in FIG. 4A, instead of the annular recess chamber 21, a semicircular recess may be formed. The upper passage 23*a* shown in FIG. 4A and FIG. 3 may be omitted. In this case, oil is replaced with air in the oil seal chamber 20 through the lower passage 23*b*. Also, as shown in FIG. 4B, oil can be injected from top.

Figure 5:
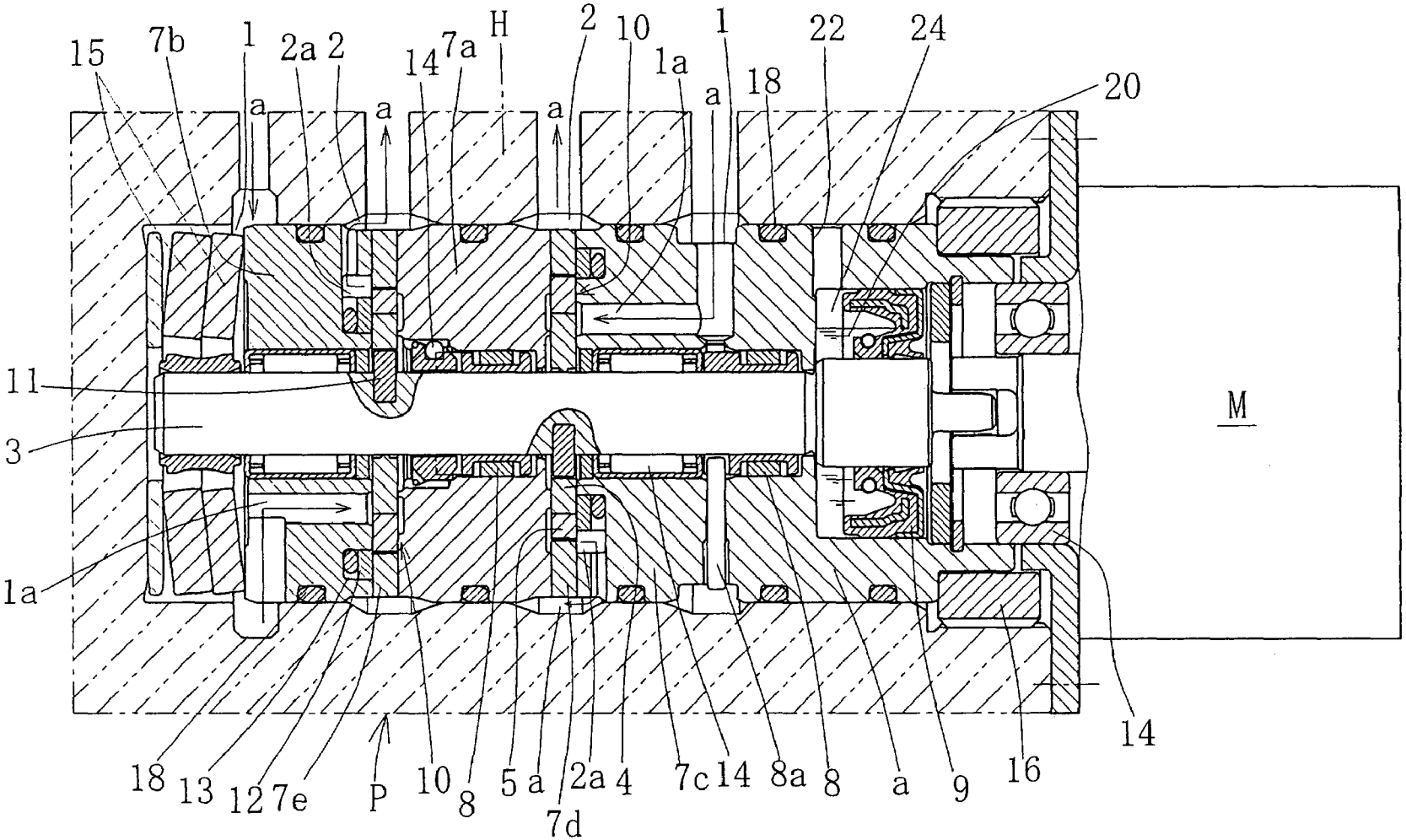
FIG. 5 is a partially cutaway front view of still another embodiment.

In the arrangement of FIG. 5, an oil injection port 22 communicating with the oil seal chamber 20 is formed in the cylinder 7*c*. In this arrangement, oil is introduced into the chamber 20 before the pump assembly P is mounted in the housing. When a required amount of oil is injected into the chamber 20, the oil pump assembly is inserted into the housing H so that the oil injection port 22 is closed by the housing. Of course, neither the recess chamber 21 nor the steel ball 22*a* is needed in this arrangement.

The invention is applicable not only to gear pump assemblies as shown, but also to any other hydraulic units which alternately produce negative and positive oil pressures in a casing and having a double oil seal mechanism comprising a high-pressure seal and a low-pressure seal. Such pressure generating units include a plunger pump used in a vehicle brake actuator and a shock absorber.

Figure 6:
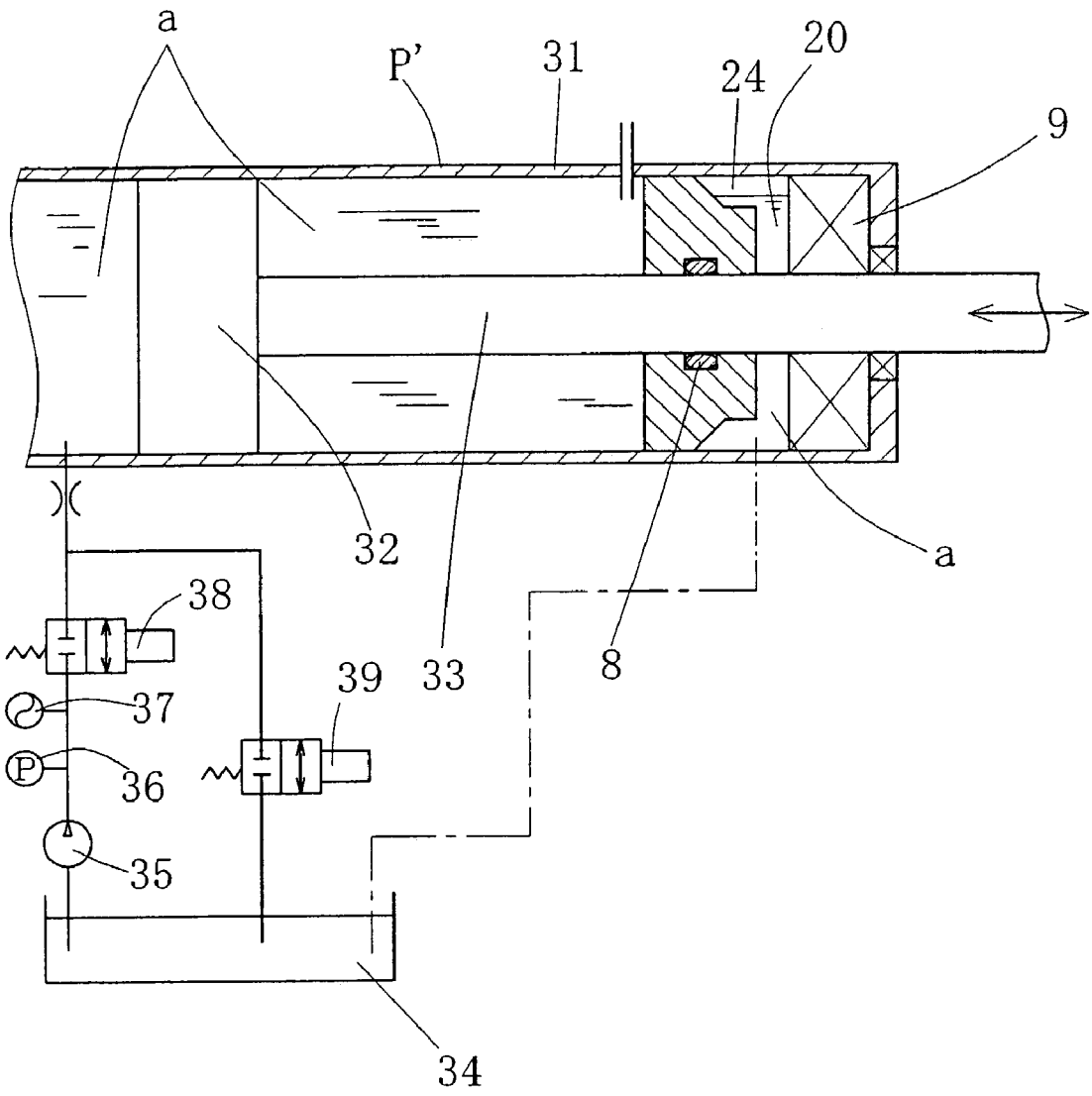
FIG. 6 is a partially cutaway front view of a further embodiment.

A shock absorber P' having the characterizing feature of the invention is shown in FIG. 6. The shock absorber P' of FIG. 6 includes an oil seal chamber 20 similar to those shown in FIGS. 1–5 between a high-pressure seal 8 and a low-pressure seal 9. Of course, the recess chambers and/or passages shown in FIGS. 1–5 may be formed. The shock absorber itself comprises a piston 32 and a piston rod 33 slidably received in the cylinder 31. Controlled hydraulic pressure is supplied to the shock absorber from a pressure source comprising a pump 35, a pressure sensor 36, a pressure accumulator 37 and solenoid valves 38 and 39.

If the oil seal chamber 20 is completely filled with oil with no air contained therein, oil in the pressure chamber of the shock absorber can leak into the oil seal chamber 20 through the high-pressure seal 8. Because oil is incompressible, there is a possibility of compressing the low-pressure seal 9 until it fails. In order to avoid this problem, it is necessary to connect the oil seal chamber 20 to a reservoir 34, as shown in FIG. 6 by dotted line, to absorb extra oil. But according to this invention, the oil seal chamber 20 is not completely filled with oil with an air layer 24 present in the chamber 20. Thus, even if oil leaks through the high-pressure seal 8 into the chamber 20, the air layer 24 is compressed, thereby absorbing any increase in the volume of the oil in the chamber 20. Thus, it is not necessary to release oil into the reservoir 34. This means that the reservoir 34 and the pipe connecting the chamber 20 with the reservoir 34 can be omitted. It is thus possible to reduce the size of the entire system.

The oil seal arrangement according to the invention improves sealability of a hydraulic unit that alternately produces positive pressure and negative pressure without unduly increasing its size.

What is claimed is:

1. An oil seal arrangement for a pump which contains oil and in which positive and negative oil pressures are alternately produced, said pump comprising a housing, a motor mounted to said housing, a cylinder fixedly mounted in said housing, a rotary shaft inserted in and rotatably supported by said cylinder and coupled to said motor at one axial end of said cylinder, and a pump unit disposed around and coupled to said rotary shaft at another axial end of said cylinder, said oil seal arrangement comprising:

a high-pressure seal mounted in said cylinder around said rotary shaft;

said high-pressure seal being disposed between said motor and said pump unit;

said pump unit being driven by said motor through said rotary shaft to suck and discharge oil into and from said cylinder;

a low-pressure seal mounted in said cylinder around said rotary shaft between said high-pressure seal and said motor; and an oil seal chamber defined in said cylinder around said rotary shaft between said high-pressure seal and said low-pressure seal;

said oil seal chamber containing oil of the same type as oil in said pump unit, said rotary shaft being completely submerged in the oil in said oil seal chamber; and said oil seal chamber being sealed from outside the housing.

2. The oil seal arrangement claimed in claim 1 wherein said oil seal chamber is not filled with said oil but an oil layer and an air layer are present in said oil seal chamber.

3. The oil seal arrangement claimed in claim 2 further comprising a recess chamber formed on the outer periphery of said cylinder around said oil seal chamber, a first passage through which said recess chamber communicates with said oil seal chamber, and an oil injection port communicating with said recess chamber.

4. The oil seal arrangement claimed in claim 1 further comprising a recess chamber formed on the outer periphery of said cylinder around said oil seal chamber, a first passage through which said recess chamber communicates with said oil seal chamber, and an oil injection port communicating with said recess chamber.

5. The oil seal arrangement claimed in claim 4 wherein said first passage is always submerged in said oil layer.

6. The oil seal arrangement claimed in claim 4 wherein said oil seal chamber and said recess chamber have both an oil layer and an air layer, said oil layer in said oil seal chamber communicates with said oil layer in said recess chamber through said first passage, and said air layer in said oil seal chamber communicates with said air layer in said recess chamber through a second passage.

7. An oil seal arrangement for a cylinder containing oil, said oil seal arrangement comprising:

a high-pressure seal mounted in said cylinder around a shaft inserted in said cylinder to seal a pressure chamber defined in said cylinder around said shaft, wherein said pressure chamber is filled with oil and positive and negative oil pressures are alternately produced in said pressure chamber;

a low-pressure seal mounted in said cylinder around said shaft between said high-pressure seal and one end of said cylinder remote from said pressure chamber; and an oil seal chamber defined in said cylinder around said shaft between said high-pressure seal and said low-pressure seal;

said oil seal chamber containing oil of the same type as oil in said pressure chamber, said shaft being completely submerged in the oil in said oil seal chamber and said oil seal chamber being sealed from outside a housing in which the cylinder is adapted to be fixedly mounted.

8. A pump, comprising:

a housing;

a motor mounted to said housing;

a cylinder fixedly mounted in said housing, said cylinder having a bore;

a rotary shaft rotatably mounted in said bore of said cylinder and coupled to said motor at a side at one axial end of said cylinder;

a pump unit comprising rotary members disposed around and coupled to said rotary shaft at a side of another axial end of said cylinder, said rotary members being driven by said rotary shaft, thereby sucking and discharging hydraulic fluid in said housing;

a first seal member mounted in said bore of said cylinder between said pump unit and said motor for sealing between an inner surface of said bore of said cylinder and an outer surface of said rotary shaft;

a second seal member mounted in said bore of said cylinder between said first seal member and said motor for sealing between the inner surface of said bore of said cylinder and the outer surface of said rotary shaft;

a seal chamber sealed from outside the housing and defined between said first and second seal members; and a hydraulic fluid of the same type as the hydraulic oil sucked and discharged by said pump unit, which is present in said seal chamber, said rotary shaft being completely submerged in the hydraulic fluid in said seal chamber.

9. The pump of claim 8, wherein the pump is a gear pump, and said rotary members comprise an inner rotor and an outer rotor.

10. The pump of claim 9, wherein said bore of said cylinder has a small-diameter portion in which said first seal member is mounted, and a large-diameter portion in which said second seal member is mounted.

11. The pump of claim 10, wherein said motor is mounted to and located outside said housing.

12. The pump of claim 11, wherein said hydraulic fluid is oil.

13. The pump of claim 8, wherein said seal chamber is not filled with said hydraulic fluid but a hydraulic fluid layer and an air layer are present in said seal chamber.

14. The pump of claim 13, further comprising a recess chamber formed on an outer periphery of said cylinder around said seal chamber, a first passage through which said recess chamber communicates with said seal chamber, and a hydraulic fluid injection port communicating with said recess chamber.

15. The pump of claim 8, further comprising a recess chamber formed on an outer periphery of said cylinder around said seal chamber, a first passage through which said recess chamber communicates with said seal chamber, and a hydraulic fluid injection port communicating with said recess chamber.

16. The pump of claim 15 wherein said first passage is always submerged in said hydraulic fluid layer.

17. The pump of claim 15, wherein said seal chamber and said recess chamber have both a hydraulic fluid layer and an air layer, said hydraulic fluid layer in said seal chamber communicates with said hydraulic fluid layer in said recess chamber through said first passage, and said air layer in said seal chamber communicates with said air layer in said recess chamber through a second passage.

* * * * *